US005316504A

United States Patent [19]

Jinno

[11] Patent Number: 5,316,504

[45] Date of Patent: May 31, 1994

[54] ELECTRICAL CONNECTOR WITH REAR HOLDER

[75] Inventor: Keishi Jinno, Shizuoka, Japan

[73] Assignee: Yazaki Corporation, Tokyo, Japan

[21] Appl. No.: 66,232

[22] Filed: May 25, 1993

[30] Foreign Application Priority Data

May 25, 1992 [JP] Japan ..... 4-132399

[51] Int. Cl.[5] ..... H01R 13/514

[52] U.S. Cl. ..... 439/752; 439/595

[58] Field of Search ..... 439/595, 596, 752

[56] References Cited

U.S. PATENT DOCUMENTS 4,721,482 1/1988 Fukuda et al. ..... 439/595

5,147,222 9/1992 Hotea et al. ..... 439/752 X

*Primary Examiner*—Eugene F. Desmond

*Attorney, Agent, or Firm*—Sughrue, Mion, Zinn, Macpeak & Seas

[57] ABSTRACT

Disclosure is an electrical connector comprising an opening of each terminal receiving chamber which is formed by cutting out an upper wall of a connector housing, and a rear holder including a movable arm portion having a plurality of terminal engagement portions formed thereon corresponding to the openings which is integrated with the connector housing via hinge bands. The rear holder is connected to the connector housing by way of two stages comprising a provisionally connected state and a normally connected state. While the provisionally connected state is shifted to the normally connected state, fitting guide projections formed on the movable arm portion are brought in the connector housing along fitting guide grooves formed in the connector housing in the forward/rearward direction so that the movable arm portion is displaced in the connector housing, causing the terminal engagement portions to enter the locus of displacement of terminals.

2 Claims, 6 Drawing Sheets

ELECTRICAL CONNECTOR WITH REAR HOLDER

BACKGROUND OF THE INVENTION

1. Field of the invention

The present invention relates to an electrical connector including a rear holder for twice preventing terminals from being disengaged from a connector housing wherein the rear holder is connected to the connector housing via flexible hinge bands.

2. Prior art

In a conventional art, in order to avoid an application of load to both fixed portion and a middle portion of long hinge band when the read holder is engaged/disengaged, a rear holder connected to a housing with a long hinge band. Thus, when the rear holder is repeatedly disengaged/engaged, the long hinge potion is prevented from being broken (cf. Japanese Examined Patent Application Publication).

FIGS. 5 and 7 are showing the conventional art. A flexible engagement arm d for preventing a terminal from being disconnected is formed in an inner wall of a terminal accommodating chamber b formed in a housinc a. The housing a has an outer wall with a rear holder insertion hole f communicated with the terminal accommodating chamber b. A rear holder i, which is provided with a terminal engaging portion h under holder base board g, is fitted to the rear holder insertion hole f and is mounted to the outer wall e with a flexible long hinge band j. The terminal engaging portion h is provided with a forward floating prevention portion k which is engaged with the inner wall of the terminal accommodating chamber toward the rear holder insertion hole f, and the rear holder i is provided with a backward floating prevention arm m having an engagement pawl l. When the rear holder i is fixed, the terminal engaging portion is slantwise inserted from the rear holder insertion hole f to the housing a in a toward direction so that the terminal c positioned in an incomplete position is driven to a position where the terminal accommodating chamber d is engaged.

However, in the conventional art, the rear holder i could not be engaged with the housing a until terminal c is inserted into the housing a. Therefore, when the electronic connecter is carried, the long hinge belt j is twisted to lead a breakage of the long hinge belt j or the rear holder i, because the long hinge belt j protrudes from the housing a.

SUMMARY OF THE INVENTION

The present invention has been made in consideration of the aforementioned first embodiment, and it resides in providing an electrical connector including a rear holder which makes it possible to smoothly shift the rear holder from the provisionally connected state to the normally connected state without twisting a hinge portion.

To accomplish the above object, the present invention provides an electrical connector including a rear holder wherein a plurality of flexible engagement pieces each serving to prevent terminals from being disengaged from a connector housing in the rearward direction are formed in a plurality of terminal receiving chambers in the connector housing, wherein the electrical connector is characterized in that openings of the terminal receiving chambers are exposed to the outside by cutting out the outer peripheral wall of the connector housing, that the rear holder including a movable arm portion having a plurality of terminal engagement portions formed thereon corresponding to the openings is integrated with the connector housing via hinge bands so that the rear holder is connected to the connector housing by way of two stages comprising a provisionally connected state and a normally connected state, that while the provisionally connected state is maintained, a plurality of fitting guide projections formed on the movable arm portion are located at the inlet positions of fitting guide grooves formed in the connector housing in the forward/rearward direction and the terminal engagement portions are dislocated away from the locus of insertion of terminals in the terminal receiving chambers, and that while the provisionally connected state is shifted from the normally connected state, the fitting guide projections are brought in the connector housing along tapered guide surfaces in the fitting guide grooves, causing the movable arm portion to be displaced so as to allow the terminal engagement portions to enter the locus of insertion of the terminals.

With the electrical connector constructed according to the present invention, as the movable arm portion is displaced in the connector housing along the fitting guide groove in the forward/rearward direction, the provisionally connected state is shifted to the normally connected state by slantwise depressing the rear holder in the forward direction.

DETAILED DESCRIPTION OF THE PREFERRED EMBODIMENTS

The present invention will now be described in detail hereinafter with reference to the accompanying drawings which illustrate preferred embodiments thereof.

As shown in FIG. 4, the electrical connector, which is first embodiment of the present invention, includes a connector housing a, and a rear holder c is integrated with the connector housing a via hinge bands b disposed at the rear end of the connector housing a on the upper surface of the same. A receiving cavity $a_1$ for receiving the rear holder c is formed at the rear end of the connector housing a on the upper surface of the same. An upper opening $d_1$ of each terminal receiving chamber d appears at the fore end part of each receiving cavity $a_1$, while a common opening $d_2$ having part of a partition wall d' of each terminal receiving chamber d removed from the latter appears at the rear end part of the receiving cavity $a_1$.

A plurality of first terminal engagement projections e are projected downward of the rear holder c at the positions located corresponding to the upper openings $d_1$ of the terminal receiving chambers d at the fore end part of the rear holder c, while a second terminal engagement projection f having a large width is projected downward of the rear holder c at the position located corresponding to the common opening $d_2$ at the rear end part of the rear holder c.

Figure 4A:
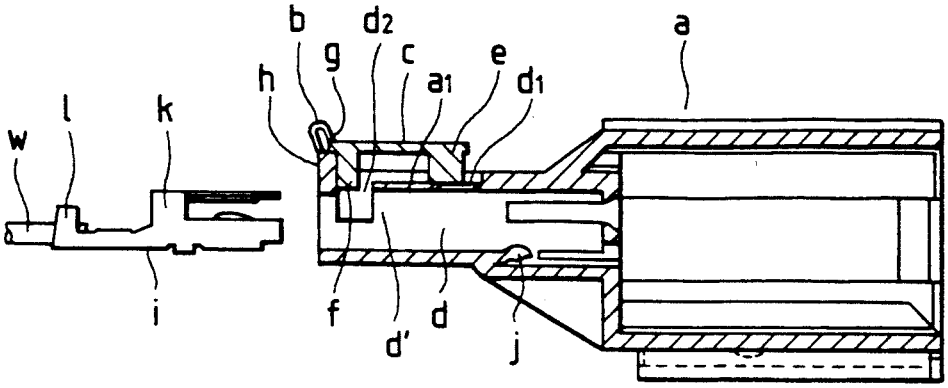
FIG. 4(A) is showing a sectional view of the electrical connector before terminals are inserted into a connector housing of the first embodiment of the present invention.
Figure 4B:
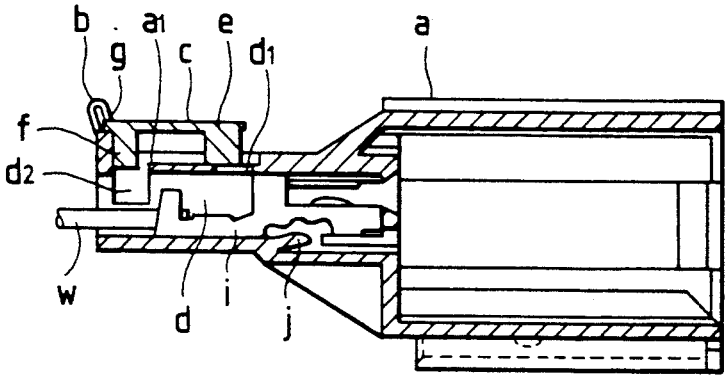
FIG. 4(B) is a sectional view of the first embodiment of the present invention in the provisionally connected state.

With this construction, first, the rear holder c is assembled with the connector housing a in the provisionally connected state (see FIG. 4(A)). While the foregoing provisionally connected state is maintained, a provisional engagement projection (not shown) of the rear holder c is engaged with an engagement portion (not shown) of the connector housing a, and moreover, a rear end g of the second terminal engagement projection f on the rear holder c is stably engaged with the upper end of a rear wall h of the connector housing a. Since the first terminal engagement projections e and the second terminal engagement projection f are located at the positions dislocated from the locus of insertion of each terminal i while the provisionally connected state is maintained, the terminal i having a wire w preliminarily connected thereto is inserted into the corresponding terminal receiving chamber d so that it is primarily held in the engaged state by a flexible engagement piece j (see FIG. 4(B)).

Figure 4C:
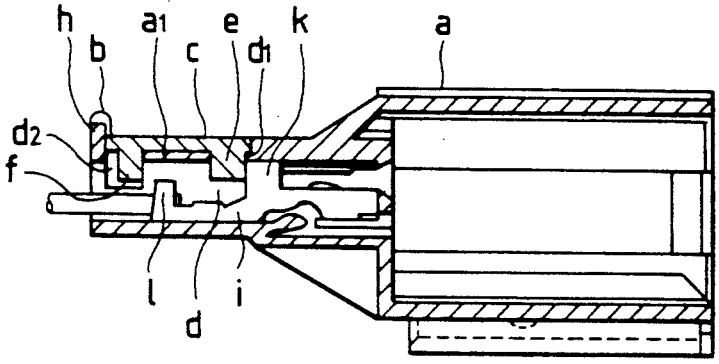
FIG. 4(C) is a sectional view of the first embodiment of the present invention in the normally connected state.
Figure 5:
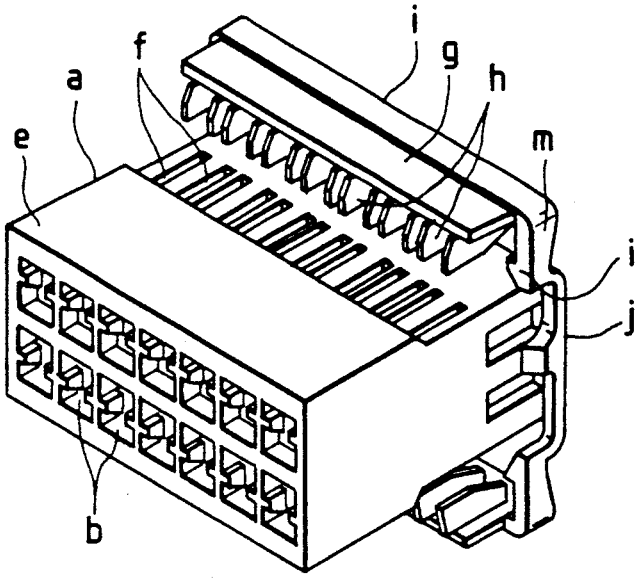
FIG. 5 is a perspective view of a conventional art in a rear holder released condition.
Figure 6:
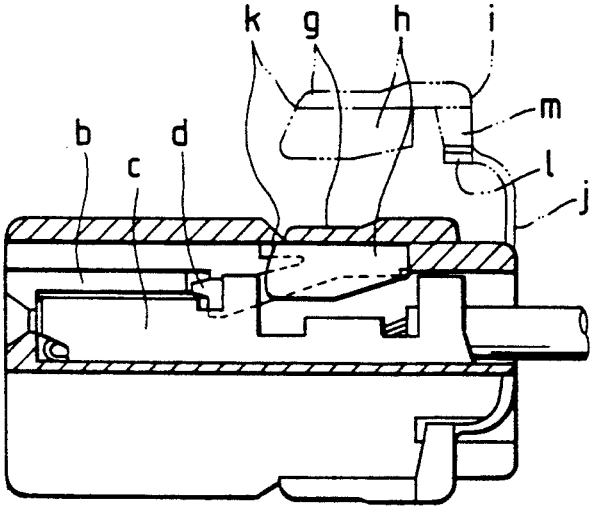
FIG. 6 is a cross sectional view of the conventional art in a connecting condition.
Figure 7:
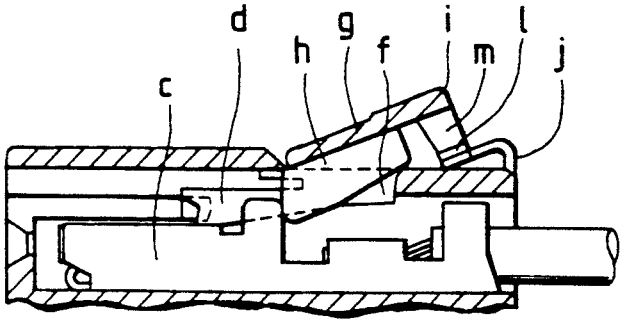
FIG. 7 is a cross sectional view of the conventional art in engagement proceeding.

While the terminal i is inserted into the corresponding terminal receiving chamber d, the rear holder c is slantwise depressed in the forward direction with an operator's hand so that a normal engagement projection (not shown) of the rear holder c is engaged with an engagement portion (not shown) of the connector housing causing the rear holder c to be normally assembled with the connector housing a (see FIG. 4(C)).

While the normally connected state is maintained, the first terminal engagement projections e of the rear holder c are located at the positions behind an electrical contact portion k of the terminal i and the second terminal engagement projection f is located at the position behind a stabilizer 1 of the terminal i, resulting in the terminal i being secondarily held in the engaged state while preventing it from being subsequently disengaged from the connector housing a.

With the electrical connector of the first embodiment of the present invention constructed in the above-described manner, when the rear holder c is shifted from the provisionally connected state to the normally connected state, it is slantwise depressed in the direction at a right angle relative to the forward/rearward direction of the connector housing a with an operator's hand while reloasing the rear holder c from the provisionally engaged state relative to the connector housing a. For this reason, the electrical connector of the first embodiment of the present invention has a drawback that an operation for shifting the rear holder c from the provisionally connected state to the normally connected state after the terminal i is inserted into the connector housing a can not smoothly be achieved with the electrical connector of the first embodiment of the present invetion.

Second embodiment of the present invention has been made in consideration of the aforementioned first embodiment, and it resides in providing an electrical connector including a rear holder which makes it possible to smoothly shift the rear holder from the provisionally connected state to the normally connected state.

Figure 1A:
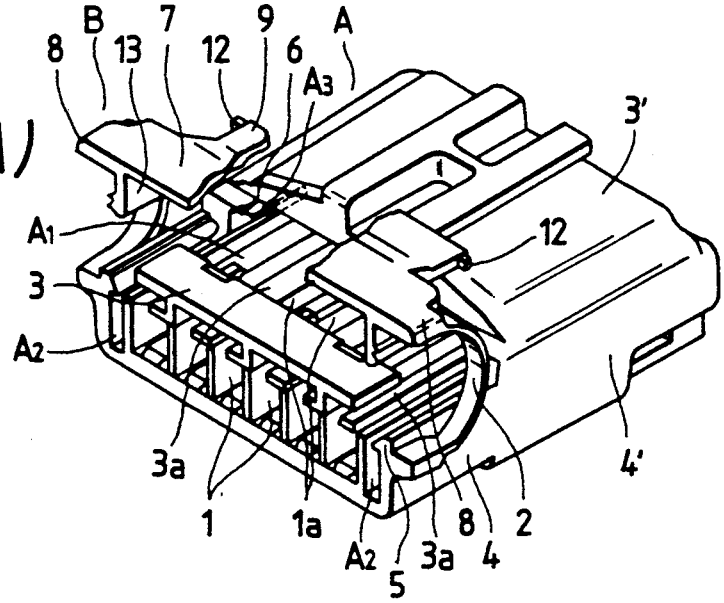
FIG. 1(A) is a perspective view of second embodiment of the present invention.
Figure 1B:
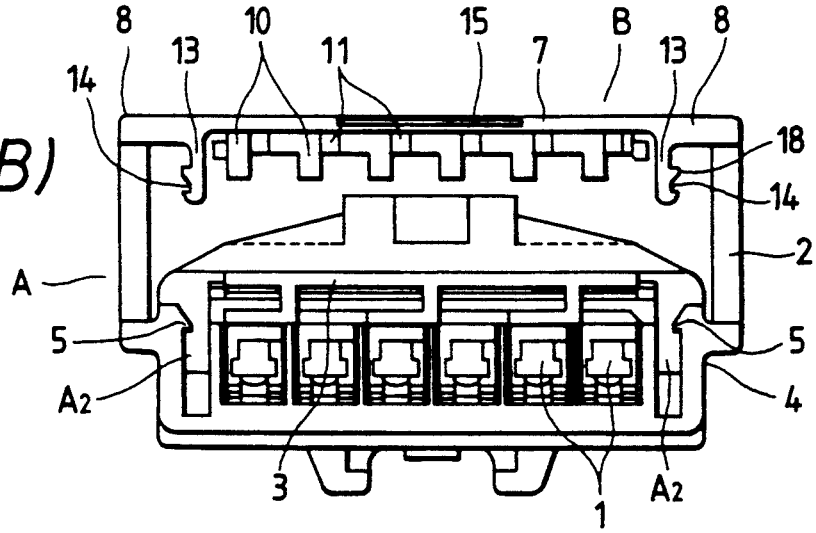
FIG. 1(B) is a rear view of the second embodiment of the present invention.
Figure 1C:
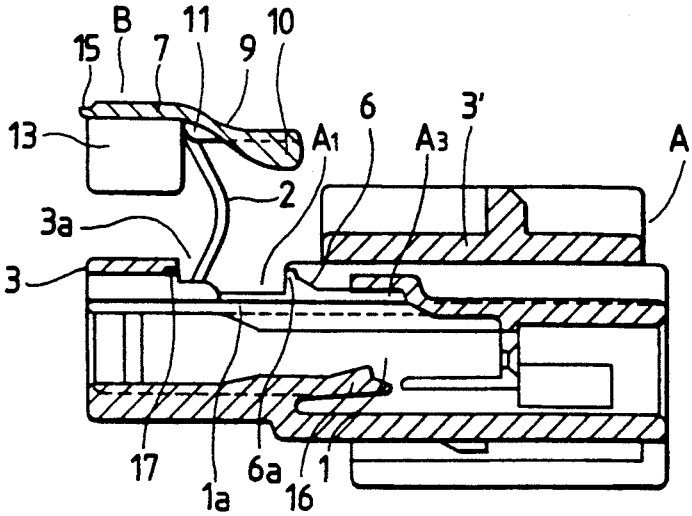
FIG. 1(C) is a sectional view of the second embodiment of the present invention.
Figure 2A:
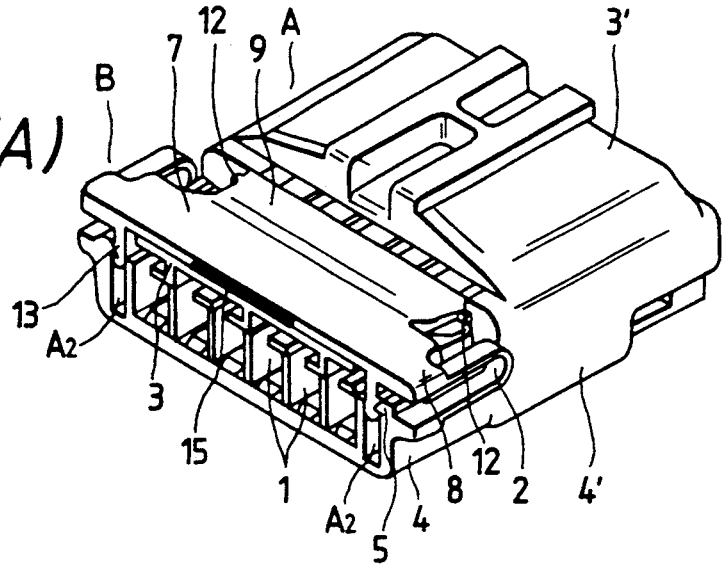
FIG. 2(A) is a perspective view of the second embodiment of the present invention in provisionally connected state.
Figure 2B:
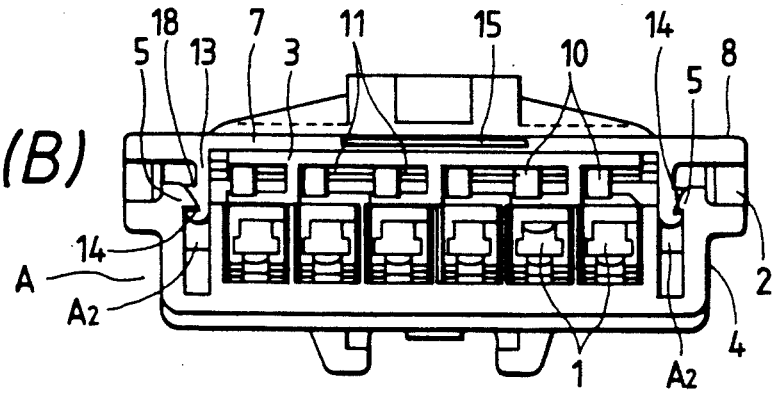
FIG. 2(B) is a rear view of the second embodiment of the present invention in provisionally connected state.
Figure 2C:
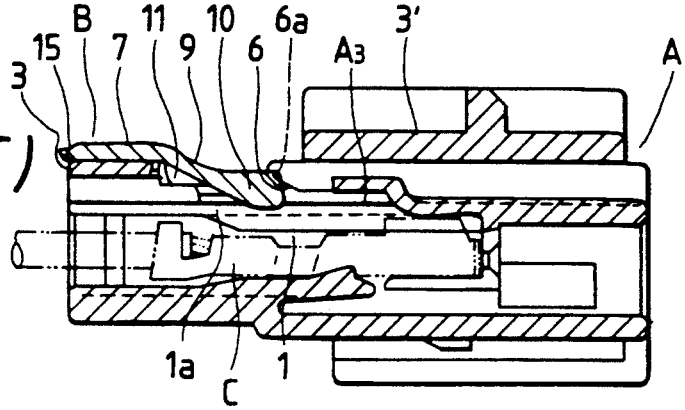
FIG. 2(C) is a sectional view of the second embodiment of the present invention in provisionally connected state.
Figure 3A:
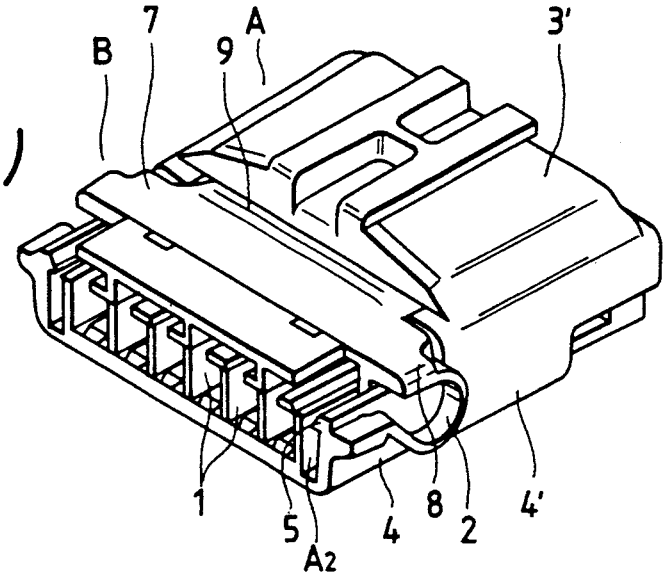
FIG. 3(A) is a perspective view of the second embodiment of the present invention in the real connected state.
Figure 3B:
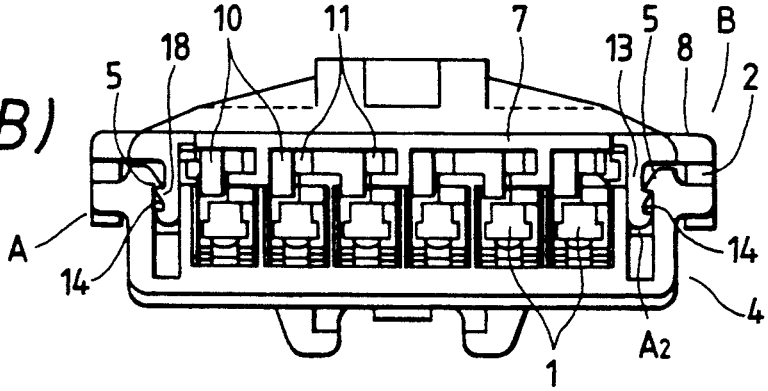
FIG. 3(B) is showing a rear view of the second embodiment of the present invention.
Figure 3C:
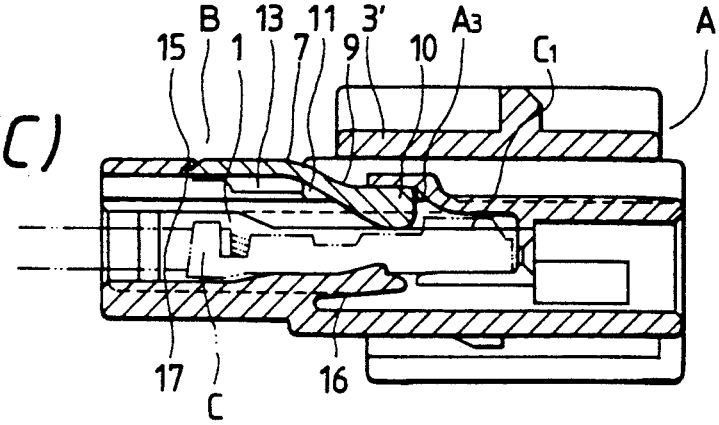
FIG. 3(C) is showing a sectional view of the second embodiment of the present invention.

Referring to FIG. 1 to FIG. 3 showing the second embodiment of the present invention, a plurality of terminal receiving chambers 1 are arranged in a connector housing A in the side-by-side relationship as seen in the leftward/rightward direction of the connector housing A. A plate-shaped rear holder B is integrated with the connector housing A at the rear upper position of the latter via flexible hinge bands 2, and a receiving cavity $A_1$ for receiving the rear holder B are defined by a cutout portion 3*a* recessed from an upper wall 3 serving as an outer peripheral wall for defining the cutout portion 3*a*. The cutout portion 3*a* continuously extends between the opposite side ends of the upper wall 3 while reaching the rear end of the same. An upper opening 1*a* of each terminal receiving chamber 1 appears at the corresponding receiving cavity $A_1$.

First fitting guide grooves $A_2$ extending along the opposite side walls of the receiving cavities $A_1$ in the forward/rearward direction are formed for the rear holder B while they are kept open in the upward direction, and guide projections 5 are formed downward of the upper ends of the opposite side walls 4 of the connector housing A corresponding to the first fitting guide grooves $A_2$. In addition, second fitting guide grooves A3 extending in the forward/rearward direction are formed inside of the fore parts 4' of the opposite side walls 4 covered with the fore part 3' of the upper wall 3, and tapered guide surfaces 6 are formed at the inlet parts of the second fitting guide grooves $A_3$ downward of a movable arm portion 9 to be described later.

The rear holder B is connected to the rear upper ends of the opposite side walls 4 via joint tabs 8 projecting outward of a plate-shaped main body 7 in the leftward/rightward direction as well as hinge bands 2 bent in the forward direction in the substantially U-shaped contour.

A movable arm portion 9 is integrated with the fore end part of the plate-shaped main body 7 of the rear holder B, and a plurality of terminal engagement portions 10 adapted to be received in the terminal receiving chambers 1 via the upper openings la are formed integral with the movable arm portion 9 on the inner wall surface of the latter. In addition, a plurality of engagement projections 11 are formed integral with the rear end part of the movable arm portion 9 downward of the inner surface of the movable arm portion 9. Fitting guide projections 12 adapted to be engaged with the second fitting grooves $A_3$ are formed integral with the movable arm portion 9 at the opposite side ends of the latter while projection sideward of the movable arm portion 9. Further, fitting guide plate portions 13 adapted to be received in the first fitting guide grooves $A_2$ are formed integral with the rear holder B on the inner surface of the connection tabs 8, guide grooves 14 adapted to be engaged with guide projections 5 are formed on the inner surfaces of the fitting guide plate portions 13, and an engagement projection 15 is formed integral with the rear end of the plate-shaped main body 7 of the rear holder B while projecting rearward of the plate-shaped main body 7 of the rear holder B.

While the electrical connector is constructed in the above-described manner, FIG. 1 shows that the rear holder B is formed integral with the connector housing A via the hinge bands 2. When the electrical connector is practically used, the rear holder A is assembled with the connector housing A in the provisionally connected state (see FIG. 2).

While the foregoing provisionally connected state is maintained, the plate-shaped main body 7 of the rear holder B is placed on the upper wall 3 of the connector housing A in the overlapped state. At this time, the fitting guide plate portions 13 are fitted into the first fitting guide grooves $A_2$ so that the guide projections 5 are engaged with the guide grooves 14. While the engagement projections 11 are located at the positions corresponding to the cutout portion 3*a* on the upper wall 3, the fitting guide projections 12 are brought in contact with a stepped part 6*a* of the tapered guide surface 6. With this construction, the guide projections 5, the guide grooves 14, the engagement projections 11, the fitting guide projections 12 and the stepped part 6*a* constitute provisional engaging means.

While the foregoing provisionally connected state is maintained, the hinge bands 2 are bent in the forward direction in the U-shaped contour while preventing further forward displacement of the rear holder B in cooperation with the stepped part 6*a* of the tapered guide surface 6 which is engaged with the fitting guide projection 12 of the rear holder B. At this time, the terminal engagement portions 10 formed on the movable arm portion 9 of the rear holder B are dislocated away from the locus of displacement of terminals C inserted into the terminal receiving chambers 1. Thus, when the terminals C each having a wire preliminarily connected thereto are inserted into the terminal receiving chambers 1 while the foregoing provisional connected state is maintained, they are primarily held in the engaged state by flexible engagement pieces 16.

Subsequently, when the rear holder B is slantwise thrusted in the forward direction with an operator's hand while it is depressed on the connector housing A, the fitting guide projections 12 are disengaged from the stepped part 6*a* of the guide surface 6 and it is then forcibly brought in the connector housing A in the inward direction along the tapered guide surface 6, causing the movable arm portion 9 to be displaced in the inward direction. Thus, the terminal engagement portions 10 enter the locus of displacement of the terminals C and move further in the forward direction, whereby the guide projections 5 are disengaged from the guide grooves 14 and the plate-shaped main body 7 of the rear holder B is then received into the receiving cavity $A_1$ formed on the upper wall 3 of the connector housing A. At this time, the engagement projection 15 is engaged with an engagement portion 17 at the foremost end of the upper wall 3 and floating preventive pawls 18 on the fitting guide plate portions 13 are engaged with the guide projections 5 to assume the normally engaged state. Thus, the engagement projection 15, the guide projections 5 and the floating preventive pawls 18 constitute normal engaging means. While the normally connected state is maintained, the terminal engaging portions 10 come near to shoulders of electrical contact portions $C_1$ of the terminals C so that the terminals C are held in the secondarily engaged state which prevents the terminals C from being disengaged from the connector housing A in the rearward direction. In case that some of the terminals C are incompletely inserted into the connector housing A while the provisionally connected state is shifted to the normally connected state, the terminal engagement portions 10 thrust the incompletely inserted terminals C in the forward direction so that the incompletely inserted terminals C are engaged with the flexible engagement pieces 16 to assume the completely inserted state As is apparent from the above description, the present invention has provided an electrical connector including a rear holder wherein a plurality of flexible engagement pieces each serving to prevent terminals from being disengaged from a connector housing in the rearward direction are formed in a plurality of terminal receiving chambers in the connector housing, wherein the electrical connector is characterized in that openings of the terminal receiving chambers are exposed to the outside by cutting out the outer peripheral wall of the connector housing, that the rear holder including a movable arm portion having a plurality of terminal engagement portions formed thereon corresponding to the openings is integrated with the connector housing via hinge bands so that the rear holder is connected to the connector housing by way of two stages comprising a provisionally connected state and a normally connected state, that while the provisionally connected state is maintained, a plurality of fitting guide projections formed on the movable arm portion are located at the inlet positions of fitting guide grooves formed in the connector housing in the forward/rearward direction and the terminal engagement portions are dislocated away from the locus of insertion of terminals in the terminal receiving chambers, and that while the provisionally connected state is shifted to the normally connected state, the fitting guide projections are brought in the connector housing along tapered guide surfaces in the fitting guide grooves, causing the movable arm portion to be displaced so as to allow the terminal engagement portions to enter the locus of insertion of the terminals. With this construction, the rear holder can smoothly be displaced from the provisionally connected state to the normally connected state relative to the connector housing. Thus, a connector assembling operation can be achieved at an increased efficiency.

While the normally connected state is maintained, since the rear holder is received in the receiving cavity defined by the outer peripheral wall of the connector housing, the whole electrical connector can be constructed in a compact configuration.

What is claimed is:

1. An electrical connector comprising:

a connector housing in which a plurality of terminal accommodating chambers are formed, each terminal accommodating chamber having a flexible engagement arm to prevent terminals form being disengaged from said connector housing, each terminal accommodating chamber having an opening portion defined by cutting out an outer peripheral wall of said connector housing; and rear holder integrally connected to said connector housing through a hinge belt, said rear holder being provided with a plurality of movable arms, said movable arms including a plurality of terminal engagement portions which are corresponded to said terminal accommodating chambers, said rear holder being engaged with said connector housing in one of provisionally connected state and a real connected state, wherein a fitting guide projection provided with each movable arm is positioned at an inlet portion of a fitting guide recess formed on said outer peripheral wall in a terminal insertion direction when said rear holder is in said provisionally connected state so that said fitting guide projection is dislocated form a path of insertion of said terminal, and said fitting guide projection is guided along a tapered guide surface of said fitting guide recess to deform said movable arm so as to insert said terminal engagement portion to said path of insertion of said terminal.

2. An electrical connector as claimed in claim 1, wherein a receiving cavity for receiving said rear holder therein is formed by cutting out the outer peripheral wall of said connector housing and said openings of said terminal accommodating chambers are located in said receiving cavity so that said rear holder is fitted in said receiving cavity when said rear holder is in said real connected state.

* * * * *